US007172722B2

(12) United States Patent
Wegstein et al.

(10) Patent No.: US 7,172,722 B2
(45) Date of Patent: Feb. 6, 2007

(54) METHOD OF VACUUM FORMING A MOLDED ARTICLE HAVING AN UNDERCUT CHANNEL

(75) Inventors: Brian Lee Wegstein, Washburn, IL (US); Phil James Davis, East Peoria, IL (US)

(73) Assignee: Hallmark Cards Incorporated, Kansas City, MI (US)

( * ) Notice: Subject to any disclaimer, the term of this patent is extended or adjusted under 35 U.S.C. 154(b) by 780 days.

(21) Appl. No.: 10/145,528

(22) Filed: May 14, 2002

(65) Prior Publication Data

US 2002/0162810 A1 Nov. 7, 2002

Related U.S. Application Data

(62) Division of application No. 09/401,217, filed on Sep. 22, 1999, now Pat. No. 6,439,399.

(51) Int. Cl.
*B29C 51/10* (2006.01)

(52) U.S. Cl. ..... 264/554; 264/318; 425/388; 425/438

(58) Field of Classification Search ..... 264/318, 264/553, 554; 425/388, 442, 438
See application file for complete search history.

(56) References Cited

U.S. PATENT DOCUMENTS

| | | | | |
|---|---|---|---|---|
| 188,519 | A | 3/1877 | Lamoree | |
| 386,964 | A | 7/1888 | Cochran | |
| 1,456,446 | A | 5/1923 | Hotaling | |
| 2,283,546 | A | 5/1942 | Fischer | |
| 2,532,600 | A | 12/1950 | Broersma | |
| 2,784,455 | A * | 3/1957 | Pulaski | 425/253 |
| 2,873,859 | A | 2/1959 | Gates | |
| 3,135,388 | A | 6/1964 | Lang | |
| 3,198,340 | A | 8/1965 | Tokash | |
| 3,577,593 | A * | 5/1971 | Jackson | 425/388 |
| 3,667,826 | A | 6/1972 | Wood et al. | |
| 3,791,651 | A | 2/1974 | Barnum et al. | |
| 3,797,795 | A | 3/1974 | Hemgren | |
| 3,865,247 | A | 2/1975 | Neglia | |
| 4,101,256 | A | 7/1978 | White et al. | |
| 4,162,014 | A | 7/1979 | Bobrick | |
| 4,334,372 | A | 6/1982 | Colmar | |
| 4,344,241 | A | 8/1982 | Tourre | |
| 4,438,680 | A | 3/1984 | Esposito | |
| 4,567,834 | A | 2/1986 | Pyka | |
| 4,607,753 | A | 8/1986 | Radek | |
| 4,613,047 | A | 9/1986 | Bushyhead et al. | |
| 4,773,545 | A | 9/1988 | Jones | |
| 4,905,845 | A | 3/1990 | Broeker et al. | |
| 4,938,366 | A | 7/1990 | Carroll | |
| 4,975,236 | A | 12/1990 | MacLachlan | |

(Continued)

*Primary Examiner*—Edmund H. Lee
(74) *Attorney, Agent, or Firm*—Leydig, Voit & Mayer, Ltd.

(57) ABSTRACT

A display unit for displaying various flat or flat-packaged articles, such as greeting cards, magazines, brochures, and the like is provided. The display unit includes a molded backboard having a plurality of walls joined to one another by a plurality of horizontal channels and a snap-in retainer for holding the displayed articles which is easily inserted into and removed from the channel of the backboard. Additionally, the present invention relates to a method of making such a molded backboard and a mold insert tool for use in forming the channel of the backboard.

7 Claims, 14 Drawing Sheets

U.S. PATENT DOCUMENTS

| | | | | |
|---|---|---|---|---|
| 4,993,561 | A | 2/1991 | Stultz | |
| 5,009,335 | A | 4/1991 | Jonker | |
| 5,014,859 | A | 5/1991 | Johnson | |
| 5,109,993 | A | 5/1992 | Hutchison | |
| 5,112,207 | A | 5/1992 | Pinsonneault | |
| 5,224,610 | A | 7/1993 | Veazey | |
| 5,289,926 | A | 3/1994 | Lewis et al. | |
| 5,297,964 | A | 3/1994 | Obersat | |
| 5,328,037 | A | 7/1994 | Fujii | |
| 5,390,462 | A | 2/1995 | Kreiter | |
| 5,419,066 | A | 5/1995 | Harnois et al. | |
| 5,497,889 | A | 3/1996 | Genovesi | |
| 5,758,781 | A | 6/1998 | Lord et al. | |
| 5,901,859 | A | 5/1999 | Carr et al. | |
| 5,928,756 | A | 7/1999 | Davis et al. | |
| 5,955,170 | A | 9/1999 | Davis et al. | |
| 5,971,171 | A | 10/1999 | Thorp et al. | |
| 5,976,663 | A | 11/1999 | Davis et al. | |
| 6,185,899 | B1 | 2/2001 | De Niet | |
| 6,193,492 | B1 * | 2/2001 | Lagnier et al. | 425/28.1 |
| 2002/0020942 | A1 * | 2/2002 | Baker et al. | 264/321 |

* cited by examiner

METHOD OF VACUUM FORMING A MOLDED ARTICLE HAVING AN UNDERCUT CHANNEL

RELATED APPLICATION

This application is a divisional of U.S. patent application Ser. No. 09/401,217, filed Sep. 22, 1999, now U.S. Pat. No. 6,439,399.

FIELD OF INVENTION

The present invention relates to a display unit for displaying various articles such as papers, cards, gift wrap and other products which are typically displayed to consumers. More particularly, the present invention relates to a display unit including a molded backboard with a channel and a snap-in retainer which is easily inserted directly into and removed from the channel of the backboard. Additionally, the present invention relates to a method of manufacturing such a molded backboard and a mold insert tool for use in forming the channel of the backboard.

BACKGROUND OF THE INVENTION

Greeting cards, wrapping paper, magazines, brochures and other articles have been displayed by a wide variety of display racks. Many of the available display racks comprise a support apparatus and a series of retainers or compartments in which the displayed products rest. The retainers or compartments are either permanently attached to the support apparatus or attached to one another. One of the problems associated with display racks in which the retainers are permanently attached to the support apparatus is that the whole display rack must be replaced in the event that a single retainer is broken. Similarly, those display racks which have multiple retainers attached as a single unit often require that the entire unit be replaced when a single retainer is damaged. Even those display racks in which the retainers are reversibly joined to one another are inconvenient for the user because they require the user to disassemble and reassemble the display rack to replace a broken retainer.

Other types of display racks have retainers or compartments which can be individually attached to a support apparatus, such as a backboard. However, these display racks have the disadvantage that the retainers or compartments are attached to the support apparatus by inserting them at one of the side ends of the apparatus and sliding them into position on the apparatus. As is often the case, the side end may be adjacent to a wall or another display rack, making the side end inaccessible and requiring the entire display unit to be physically moved from its location to engage the new retainer.

SUMMARY OF THE INVENTION

Accordingly, the present invention provides a display unit for storing and displaying cards, magazines, and other flat articles. Also provided is a mold insert for use in molding articles having an undercut channel. Further, a method for producing molded articles having an undercut channel is provided.

A display unit for storing and displaying articles is provided which comprises a backboard having a front surface and a rear surface. The front surface has at least two walls joined by an undercut channel extending horizontally along at least some predetermined width of the display unit.

The display unit also includes a retainer for maintaining articles in the display unit. The retainer comprises a bracket including first and second extensions such that the retainer may be directly inserted into the undercut channel. The display preferably is formed by vacuum forming a thermoplastic sheet of material such as a high impact polystyrene. The retainer preferably is formed by injection molding a thermoplastic material such as an acrylic.

The display unit further may include one or more integrally molded rear support brackets. Also, the display may also include integrally molded vertical channels.

In the display unit, the opening of the undercut channel is narrower in width than the back wall of said channel. In addition, the retainer preferably engages the molded backboard directly without the necessity of sliding the bracket into the molded backboard channel from one end of the channel.

A mold insert for forming an undercut channel in a molded article is also provided. The mold insert assume a triangular configuration during molding suitable for molding an undercut channel and then shifts to a release position upon withdrawal of the molded article. The mold insert preferably is from a unshaped first section, second, third and fourth hinged sections, and a fifth straight section. The the second hinged section is fixedly joined to said unshaped first section such as by tack welding. The third hinged section is fixedly attached to the second hinged section also such as by tack welding. The fourth hinged section is fixedly attached to the third hinged section and the four hinged section is fixedly attached to the fifth straight section, both by such means as tack welding. The fifth straight section is movably located with the channel of the unshaped first section when assembled. The second, third and fourth hinged sections each include first and second panels connected to each other by a hinge joint and hinge pin.

A method of vacuum forming a molded article having an undercut channel is also contemplated. In the method, a mold containing a mold insert is provided, wherein the mold insert assumes a triangular configuration during molding suitable for molding an undercut channel and wherein the mold insert shifts to a release position upon withdrawal of said molded article. A thermoplastic blank sheet is placed on the mold and the sheet is molded to form the molded article having an undercut channel. The molded article is removed from the mold, wherein during removal, the mold insert shifts into a release configuration, allowing the molded article to be released from the mold.

Preferably in practicing the method, the mold insert automatically returns to the molding position following removal of the molded article. Also, where the mold insert does not automatically return to the molding position upon removal of a molded article, preferably, the mold insert automatically returns to the molding position upon insertion of a thermoplastic blank sheet due to the weight of the sheet on the mold insert. Preferably, the mold insert is a hinged mold insert.

Preferably, this method is practiced to form the molded backboard of the invention which is suitable for displaying products.

These and other features and advantages of the invention will be more readily apparent upon reading the following description of a preferred exemplified embodiment of the invention and upon reference to the accompanying drawings.

Figure 1:
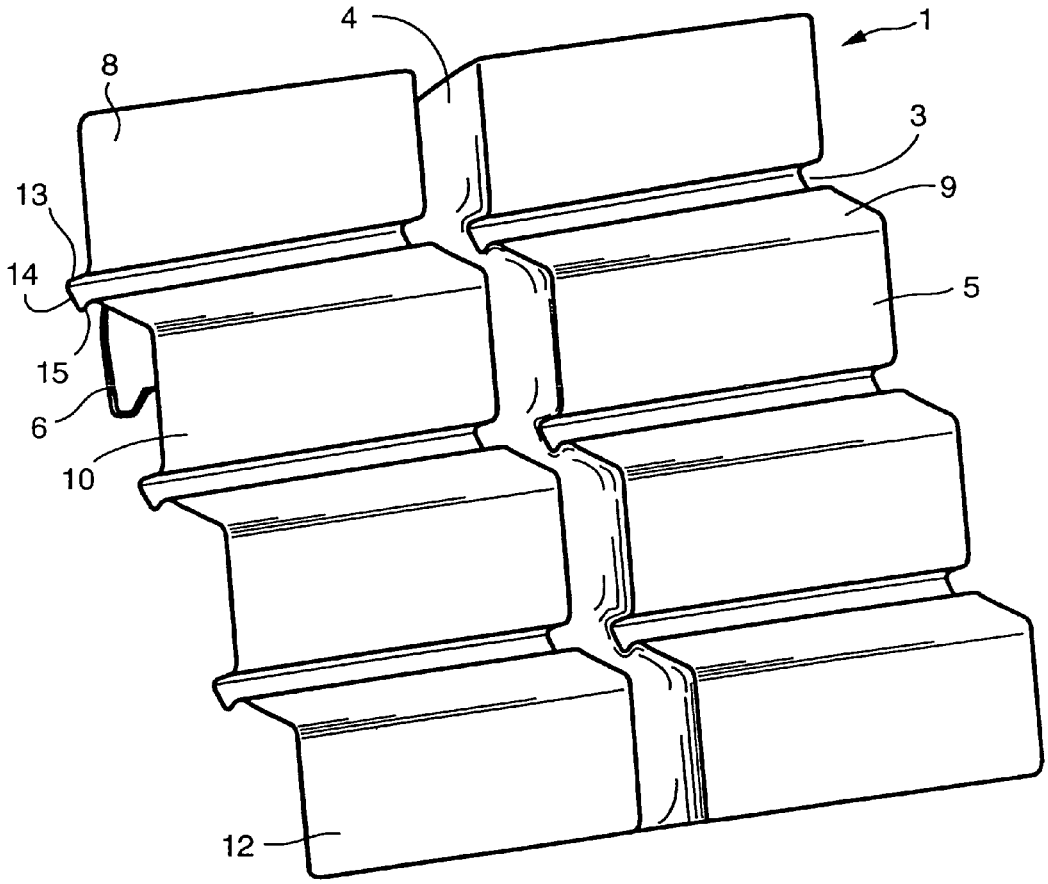
FIG. 1 is a partial perspective view of the front surface of the molded backboard according to the present invention wherein the molded backboard has a plurality of channels for engaging snap-in retainers.

While the invention will be described and disclosed in connection with certain preferred embodiments and procedures, it is not intended to limit the invention to those specific embodiments. Rather it is intended to cover all such alternative embodiments and modifications as fall within the spirit and scope of the invention.

DETAILED DESCRIPTION OF THE PREFERRED EMBODIMENT

Referring generally to the above figures, the present invention provides a display unit for storing and displaying articles such as greeting cards, wrapping paper, magazines, and other such products to consumers. The display unit includes a unitary molded backboard 1 having a top wall 8, a bottom wall 12, and a plurality of vertical walls 10 arranged in a tiered fashion and a plurality of horizontal channels 3, each of which can engage a snap-in retainer 2. The walls 8, 10, 12 of the molded backboard, in conjunction with the snap-in retainers 2, form a vertical array of compartments in which the displayed products rest and which maintain the products on the display rack. The channel 3 of the molded backboard 1 and the snap-in retainer 2 are formed such that the retainer snaps directly into the channel from the front, allowing for easy insertion and removal of the retainer 2 from the backboard 1. Also, provided is a method for vacuum molding the backboard 1 and a mold insert 40 for use in forming the channel 3 during vacuum molding of the backboard 1.

Figure 2:
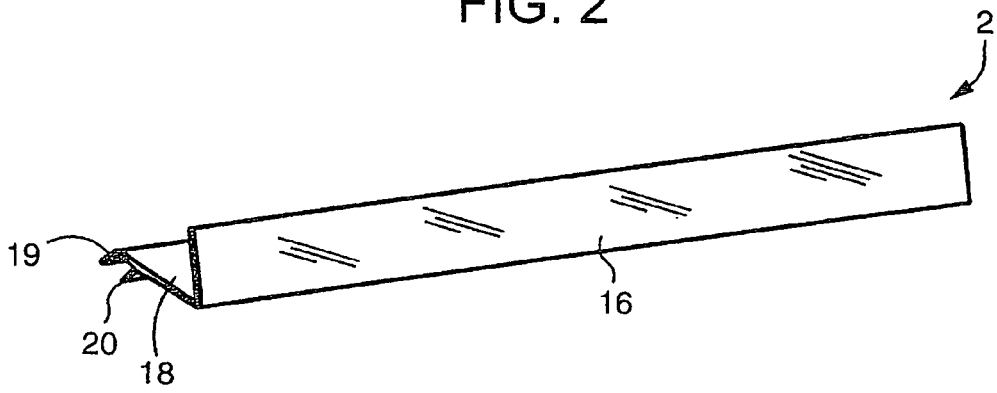
FIG. 2 is a perspective view of the snap-in retainer which engages a channel of the molded backboard seen in FIG. 1.
Figure 12:
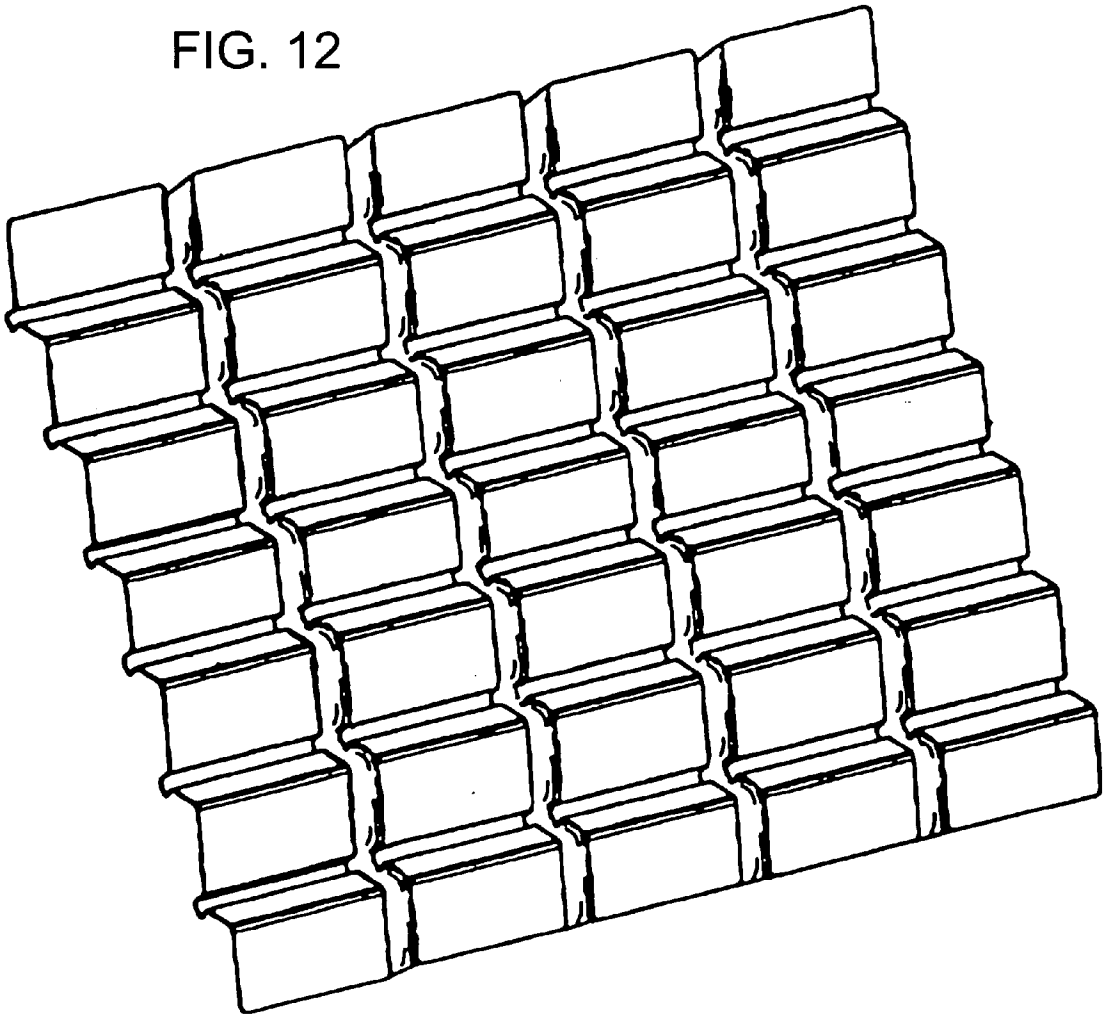
FIG. 12 is a perspective view of the front surface of the molded backboard according to the present invention.

As seen in FIGS. 1 and 2, and 12, the display unit of the present invention comprises a molded backboard 1 and a snap-in retainer 2. The molded backboard 1 is supported by a base which either rests on a floor surface or is mounted to a wall or other immobilized structure. FIG. 1 illustrates a portion of the molded backboard 1, which includes a front surface 5 and a rear surface 6. The backboard 1 is molded such that the front surface 5 generally includes the top wall 8, the bottom wall 12, the plurality of walls 10 separated by transverse channels 3, and sloped walls 9. Vertical grooves 4 are formed as a result of the formation of hanging brackets on the rear surface 6 of the backboard 1.

In the vertical direction, the walls 8, 10, 12 are joined to one another such that they form a continuous array of walls arranged in a tiered fashion. Beginning at the top of the molded backboard 1, the top wall 8 is joined to a first wall 10 by a horizontal channel 3 and a sloped wall 9, presenting a pleasing display appearance. The bottom of the top wall 8 continues to form the first horizontal channel 3, which, in turn, continues to form the first sloped wall 9, which continues to form the top of the first wall 10. The first wall 10 is then joined to a second wall 10 by a second horizontal channel 3 and a second sloped wall 9 in the same manner and, likewise, further walls 10 are joined together that same way such that an array of walls is formed ending with a bottom.

In the horizontal direction, the walls 8, 10, 12 are joined by a series of vertical grooves 4, as seen in FIGS. 1 and 12, formed as a result of the formation of rear support brackets. Where rear brackets are created separately or are unnecessary, the vertical grooves may be eliminated or included only for visual effect. However where the walls 8, 10, 12 extend in the horizontal direction over about eighteen inches, the vertical grooves provide structural strength. The individual walls 8, 10, 12 can be various lengths and widths as long as they are of sufficient height and length to maintain, in conjunction with a retainer 2, the display articles on the display unit. The vertical walls may be of any suitable height and width, preferably, the walls 8, 10, 12 are from about 2.5 inches to about 11 inches in length and from about 3 inches to about 4 inches in height. Also, there may be any number of walls in the molded backboard 1, including a single wall in the vertical direction and a single wall in the horizontal direction.

As discussed above, the walls 8, 10, 12 are joined to one another via a horizontal channel 3 and a sloped wall 9. The channel 3 of the molded backboard 1 is of a suitable configuration to permit the snap-in retainer 2 to engage and also remain secured to the front surface 5 of the molded backboard 1. Preferably, as shown in FIG. 1, the channel is generally U-shaped, having two side walls 13 and 15 and a bottom wall 14 and preferably, the channel takes the form of an undercut channel. Also, the channel 3 has sufficient depth so as to allow the snap-in retainer 2 to be inserted into the channel 3 from the front.

The sloped wall 9 of the molded backboard 1 is formed such that the snap-in retainer 2 rests on the surface of the sloped wall 9 when it is engaged with the channel 3. Preferably, the sloped wall 9 is formed such that it forms from about a 110° to about a 130° angle with the wall 10 immediately below the sloped wall 9. More preferably, the sloped wall 9 forms about a 120° angle with the wall 10 directly below The molded backboard 1 may be formed from any suitable plastic material that is sufficiently resilient to contain and store the desired articles. Preferably, the plastic material is thermoplastic. Preferably, the molded backboard 1 is formed by vacuum molding, using a thermoplastic material such as described above. Suitable plastics for use in manufacturing the molded backboard include high impact polystyrenes. Preferably, the high impact polystyrene or other thermoplastic has a thickness of about 0.090 inches.

As seen in FIG. 2, the snap-in retainer 2 is generally L-shaped and includes a front wall 16, and a bottom wall 18. The bottom wall 18 includes first and second extensions 19, 20 at its free end which form a generally U-shaped structure and which permit the retainer 2 to engage the channel 3 of the molded backboard 1. The first and second extensions 19, 20 extend away from the bottom wall 18 in a downward direction. Preferably the first and second extensions 19, 20 extend along the entire length of the bottom wall 18. When engaged with the molded backboard 1, the retainer 2 forms a compartment, defined by the wall 8 (or 10 or 12) and the bottom wall 18 of the snap-in retainer and the front wall 16. The compartment backboard is suitable to contain and display articles. Accordingly, the retainer 2 may have various lengths and the front wall 16 may have various heights as long as the retainer 2 has sufficient length and height to contain the desired article when the retainer is engaged with the molded backboard 1. Preferably, the retainer 2 has a length of from about 24 inches to about 48 inches and the front wall 16 has a height of from about 2 inches to about 6 inches.

Figure 2A:
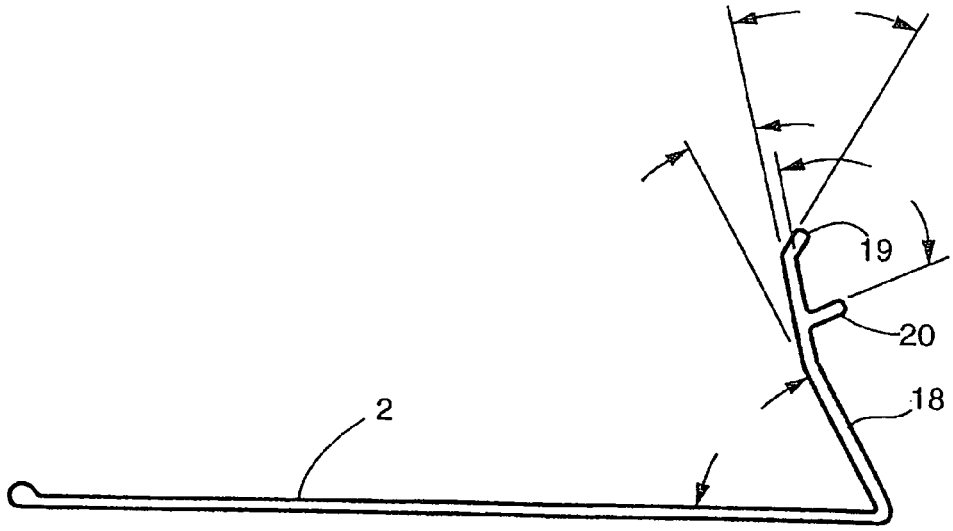
FIG. 2*a* is an enlarged side view of a preferred embodiment of the snap-in retainer seen in FIG. 2.

In a preferred embodiment shown in FIG. 2*a,* the first extension 19 extends from the side of the retainer bottom wall 18 at angle X of about 41°. The bottom wall continues and then turns at an angle of about 75.7° to form the second extension 20. The portion of the bottom wall 18 from the first extension 19 to the second extension 20 may include a bend angle of about 15°.

Figure 3:
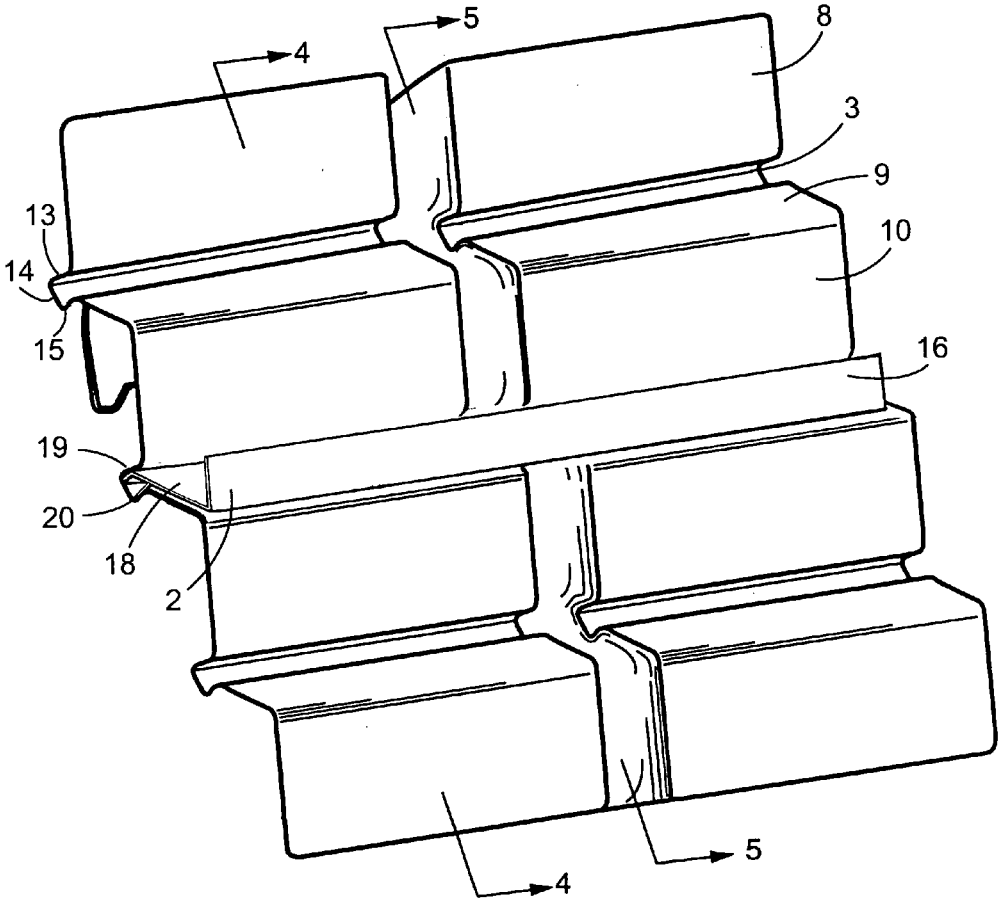
FIG. 3 is a partial perspective view of the molded backboard and snap-in retainer as seen in FIGS. 1 and 2, illustrating the snap-in retainer engaged with a channel of the molded backboard.
Figure 4:
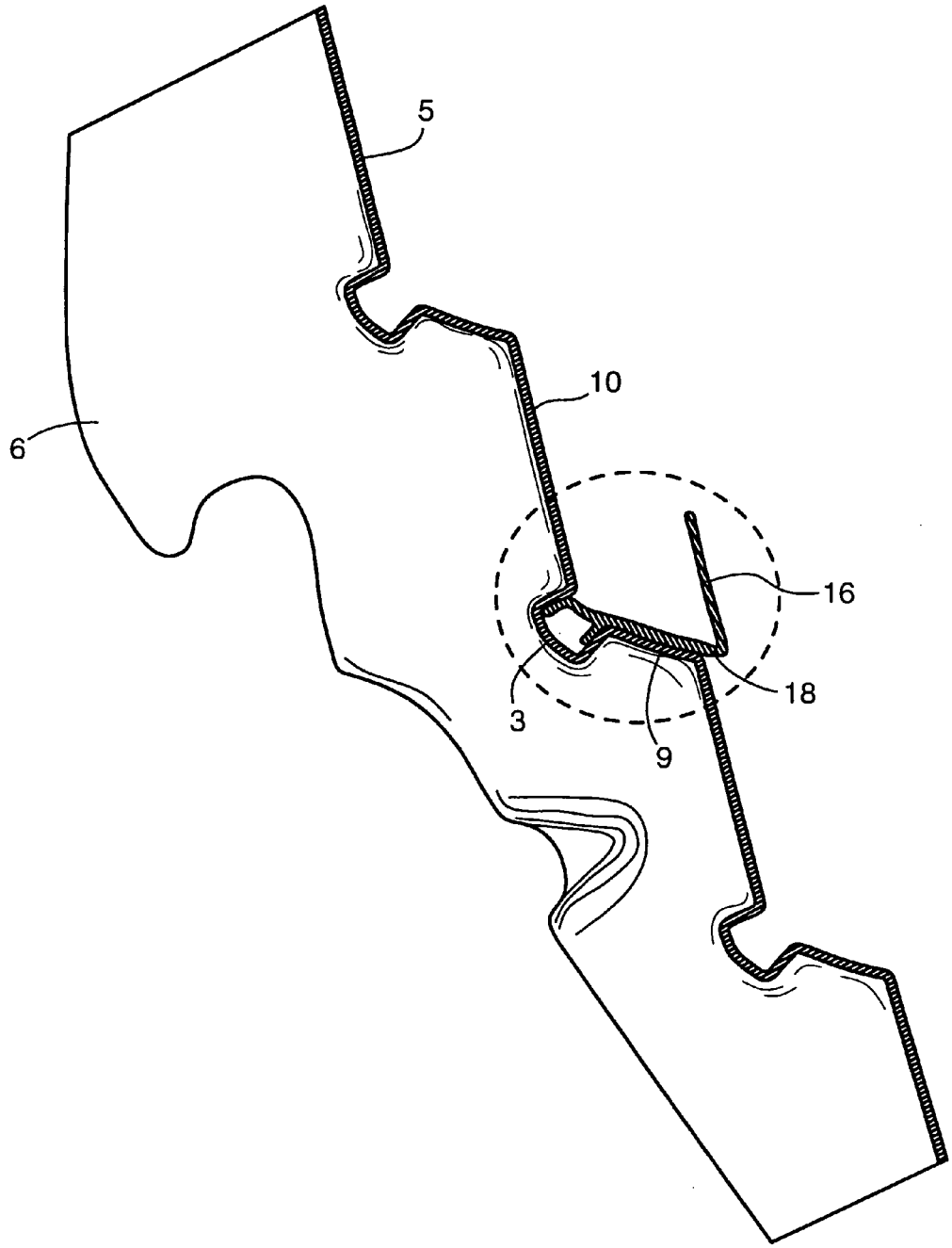
FIG. 4 is a cross-section of the front surface of the molded backboard and snap-in retainer as seen in FIG. 3 along a section line 4.

As can be seen in FIGS. 3 and 4, the retainer 2 engages the molded backboard 1 such that the extensions 18, 19 engage the channel 3, the bottom wall 18 rests on the sloped wall 9, and the front wall 16 is about parallel with the backboard wall 8 (or 10 or 12) with which it forms a compartment. Accordingly, the extensions 19, 20 are preferably of a suitable configuration to permit the retainer 2 to be engaged and remain secured to the channel 3 of the molded backboard 1. Also, preferably, the profile of the retainer bottom wall 18 and extension 19 is complementary with the profile of the sloped wall 9 and sidewall 15 of the channel 3 so that the bottom wall 18 rests on the sloped wall 9 and the retainer front wall 16 is flush or nearly flush with the backboard wall directly below the snap-in retainer 2 when the retainer extensions 18, 19 are engaged with the channel 3. In addition, preferably the bottom wall 18 and front wall 16 of the retainer 2 are joined at such an angle that the front wall 16 is about parallel with the wall 8 (or 10 or 12) with which the retainer forms a compartment when the retainer 2 is engaged with the backboard 1. In the embodiment shown in FIG. 4, preferably the retainer bottom wall 18 and front wall 16 are joined at an angle from about 55° to about 75°.

The snap-in retainer 2 may be formed from any suitable plastic material that is sufficiently resilient to contain the desired articles on the molded rack. Preferably, the plastic material is thermoplastic. One suitable plastic for use in manufacturing the snap-in retainer is acrylic. Preferably, if acrylic is used, the acrylic is mixed with dr blend. The plastic material used to form the retainer 2 may be opaque or translucent and may be colored to any suitable color.

The retainer 2 may be formed in several ways, including profile extrusion and injection molding. Preferably, the retainer 2 is formed by injection molding.

Figure 4A:
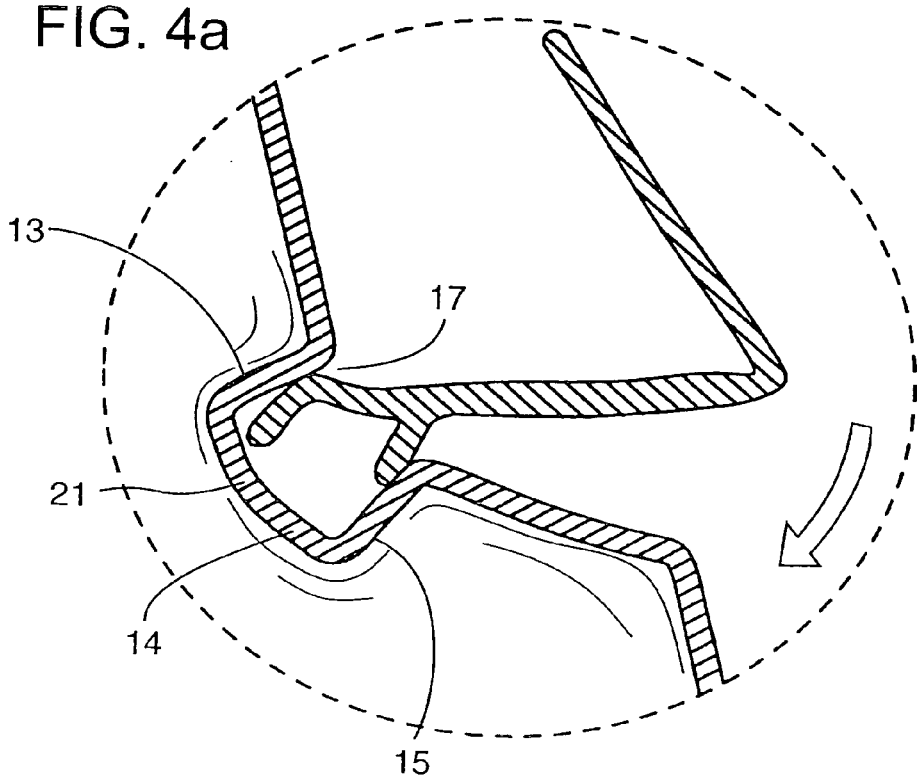
FIG. 4*a–b* is an exploded view of the cross-section illustrating the molded backboard and snap-in retainer configuration suitable for engaging the snap-in retainer with the molded backboard.
Figure 4B:
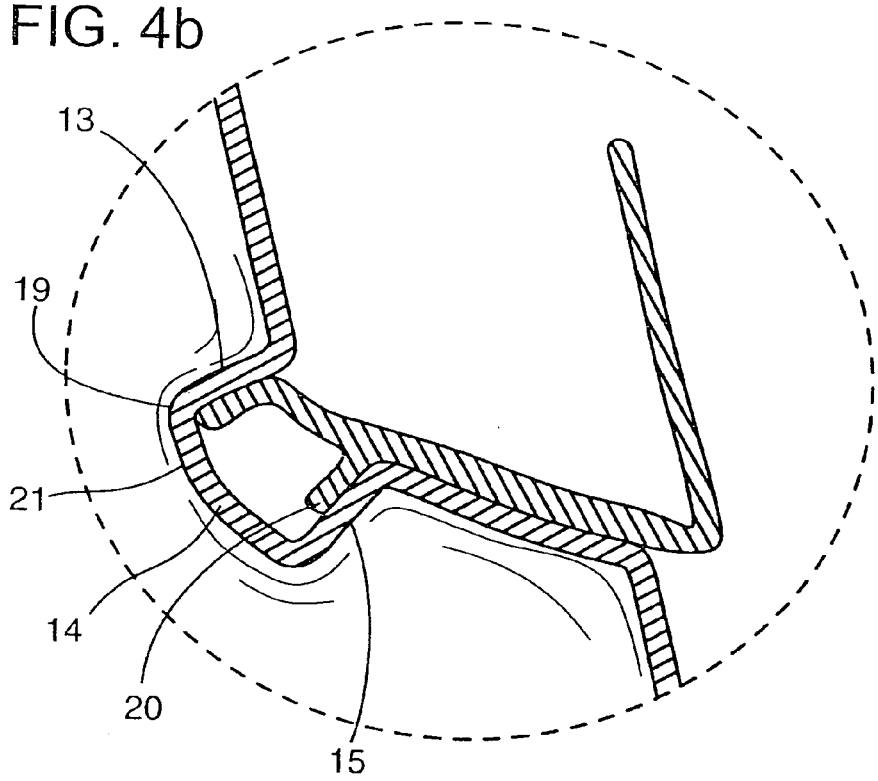

The channel 3 of the molded backboard and the extensions 19, 20 of the snap-in retainer 2 are each preferably of a suitable configuration to permit the retainer to be engaged and remain secured with the channel 3 of the molded backboard 1. One suitable configuration of the channel 3 is illustrated in FIGS. 4*a* and 4*b*. Preferably, the upper side wall is joined to the backboard wall at an angle of from about 100° to about 108°. Also, preferably the channel lower side wall 15 is joined to the slope wall 9 at an angle of from about 105° to about 113°. The channel upper side wall 13 and lower side wall 15 are joined by the channel bottom wall 14. The channel upper wall 13 and lower side wall 15 are joined by the channel bottom wall 14. The channel upper and lower sidewalls 13 and 15 of the generally U-shaped channel 3 are angled such that the opening at the mouth 17 of the channel 3 is narrower than the width of the channel as measured along the bottom wall 14, resulting in an undercut channel 3. Also, the undercut channel 3 may be formed such that the corner formed by the sidewall 13 and the bottom 14 lies further back from the front surface 5 than the corner formed by the sidewall 15 and the bottom 14. Additionally, the channel 3 may have a ridge 21 on the bottom wall 14 to further secure the retainer 2.

The snap-in retainer 2 includes a front wall 16 and a bottom wall 18 having two extensions 19, 20 which permit the retainer 2 to engage the channel 3. Specifically, the retainer 2 is formed such that the first extension 19 contacts the sidewall 13 and the second extension 20 contacts the sidewall 15 when the retainer 2 is engaged with the channel 3.

The retainer 2 is engaged with the undercut channel 3 as shown in FIGS. 4*a* and 4*b*. Given that the distance between the sidewalls 13 and 15 at the opening of the mouth of the channel 3 is less than the distance between the first and second extensions 19 and 20, the retainer 2 is inserted into the channel 3 by first contacting the first extension 19 with the sidewall 13 and backwall 14 and then pushing down, causing the retainer to snap into place such that the first extension 19 contacts the sidewall 13, the second extension 20 contacts the sidewall 15, and the bottom wall 18 rests on the sloped wall 9. The shape of the channel 3 whereby the corner formed by the sidewall 13 and the bottom 14 lies further back from the front surface 5 provides the necessary depth to insert the retainer 2 in this manner and also ensures that the retainer 2 will not slip out of the channel 3 once it is engaged.

Figure 5:
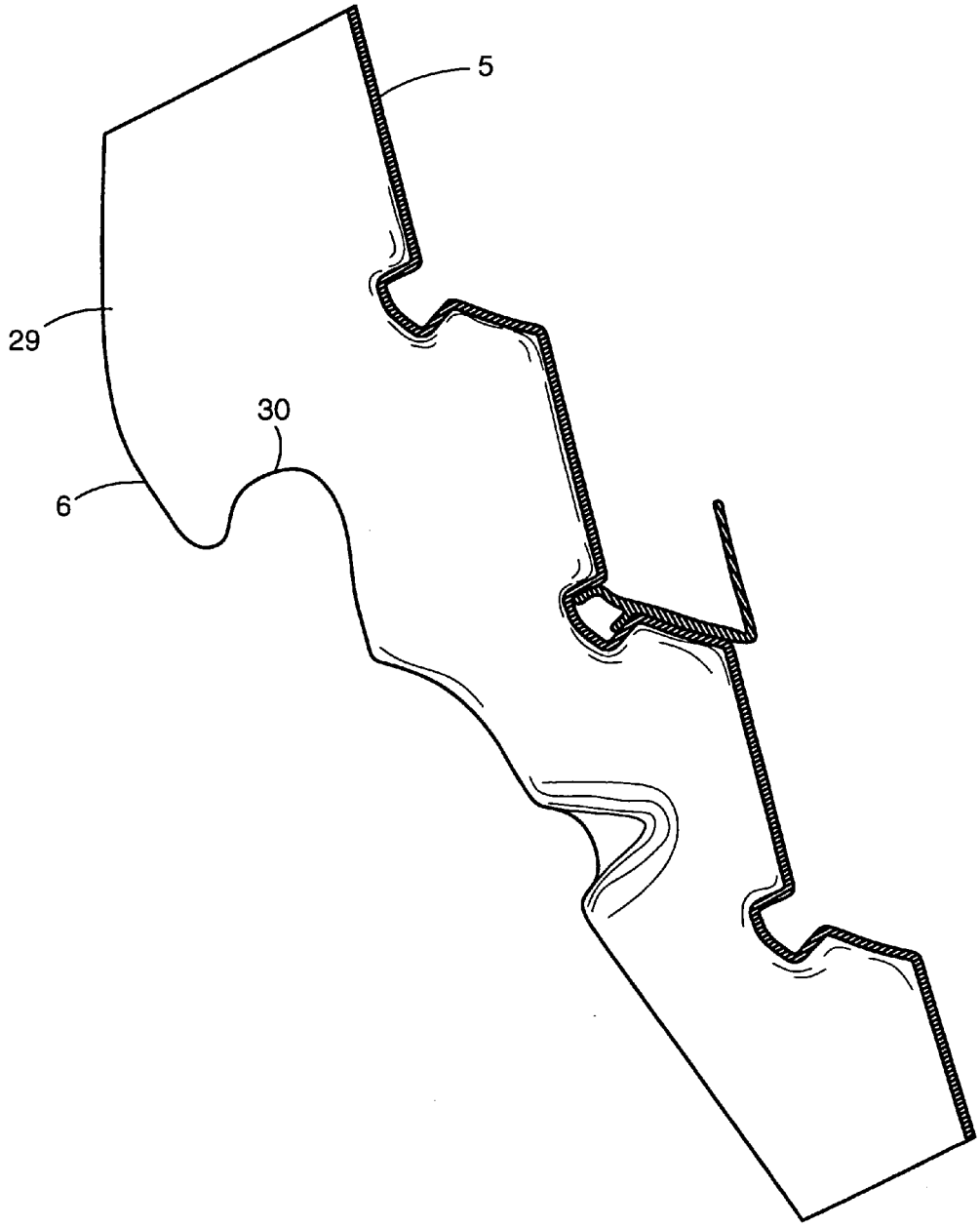
FIG. 5 is a cross-section of the rear surface of the molded backboard and snap-in retainer as seen in FIG. 3 along a section line 5.
Figure 13:
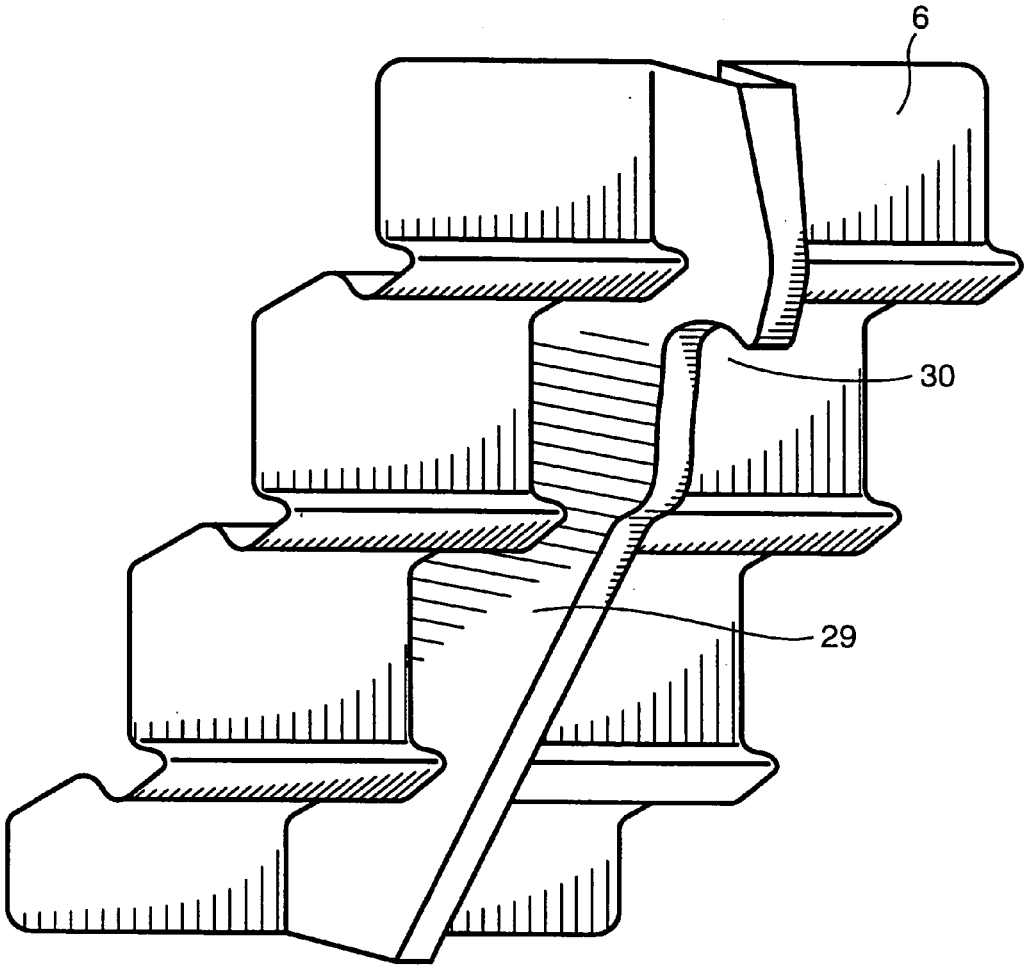
FIG. 13 is a perspective view of a portion of the rear surface of the molded backboard according to the present invention.

The molded backboard 1 of the present invention also includes a rear surface 6, as shown in FIGS. 5 and 13. The rear surface 6 is molded such that it has a shape complementary with the front surface 5, including a protruded area 29 which extends vertically along the entire length of the backboard 1 and corresponds with the groove 4 of the front surface 5. The protruded area 29 may have various shapes as long as the shape allows the backboard 1 to be secured to a standing frame or otherwise immobilized. As seen in FIG. 5, the protruded area 29 may include at least one horizontal groove 30 by which to hook the backboard 1 onto a standing frame. The horizontal groove 30 may be various shapes and sizes, but preferably has a shape which is complementary to the means by which the backboard is secured to the standing frame. For instance, in the embodiment shown in FIG. 5, the horizontal groove 30 is rounded so as to allow the backboard 1 to be secured by a round rod of the standing frame.

Figures 6A, 6B:
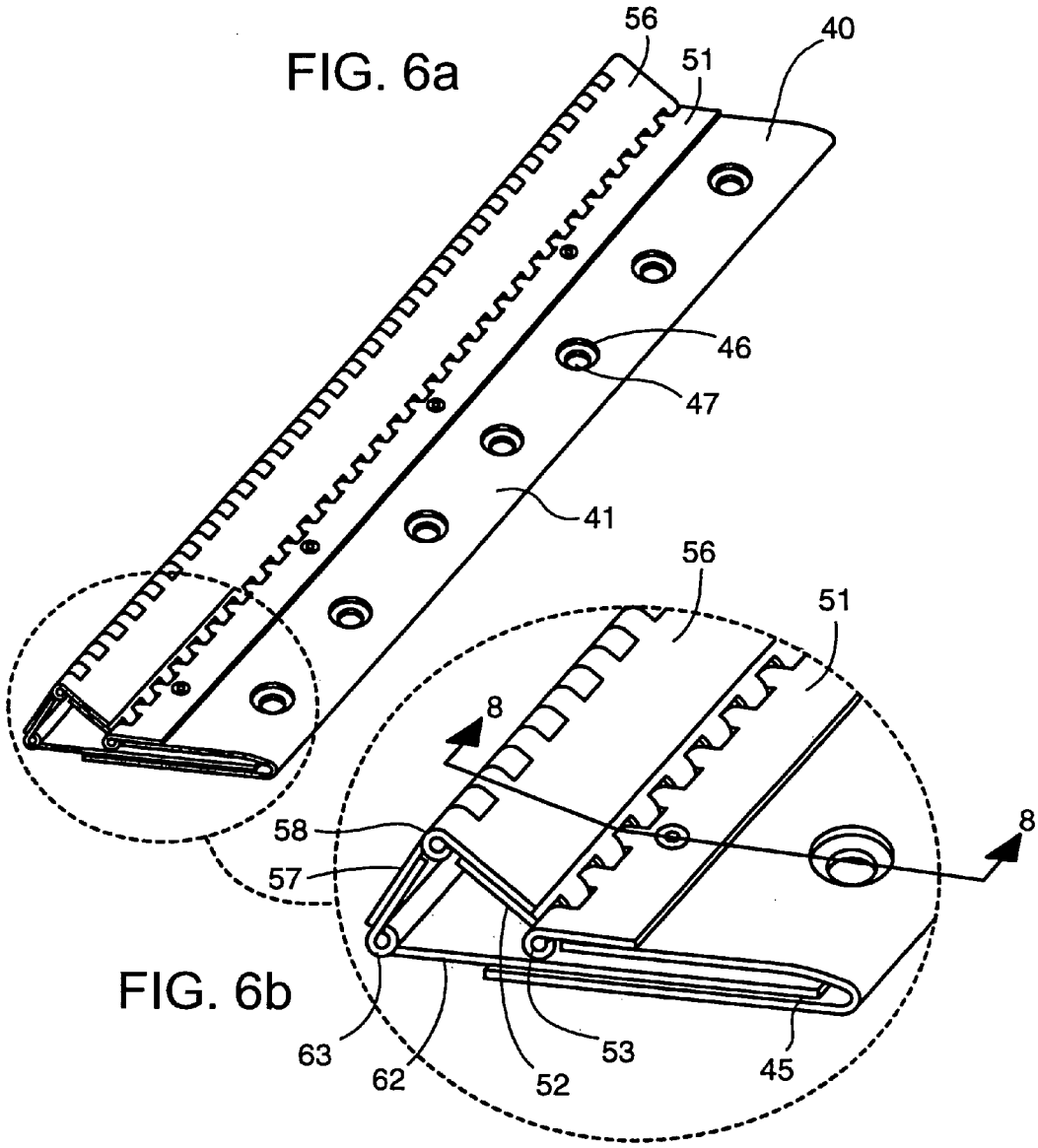
FIG. 6*a* is a perspective view of the hinged mold insert according to the present invention in the triangular configuration used for forming a channel of the molded backboard.
FIG. 6*b* is an enlarged view of one end of the hinged mold insert as seen in FIG. 6*a,* illustrating the hinge configuration suitable for forming a channel of the molded backboard.
Figures 7A, 7B:
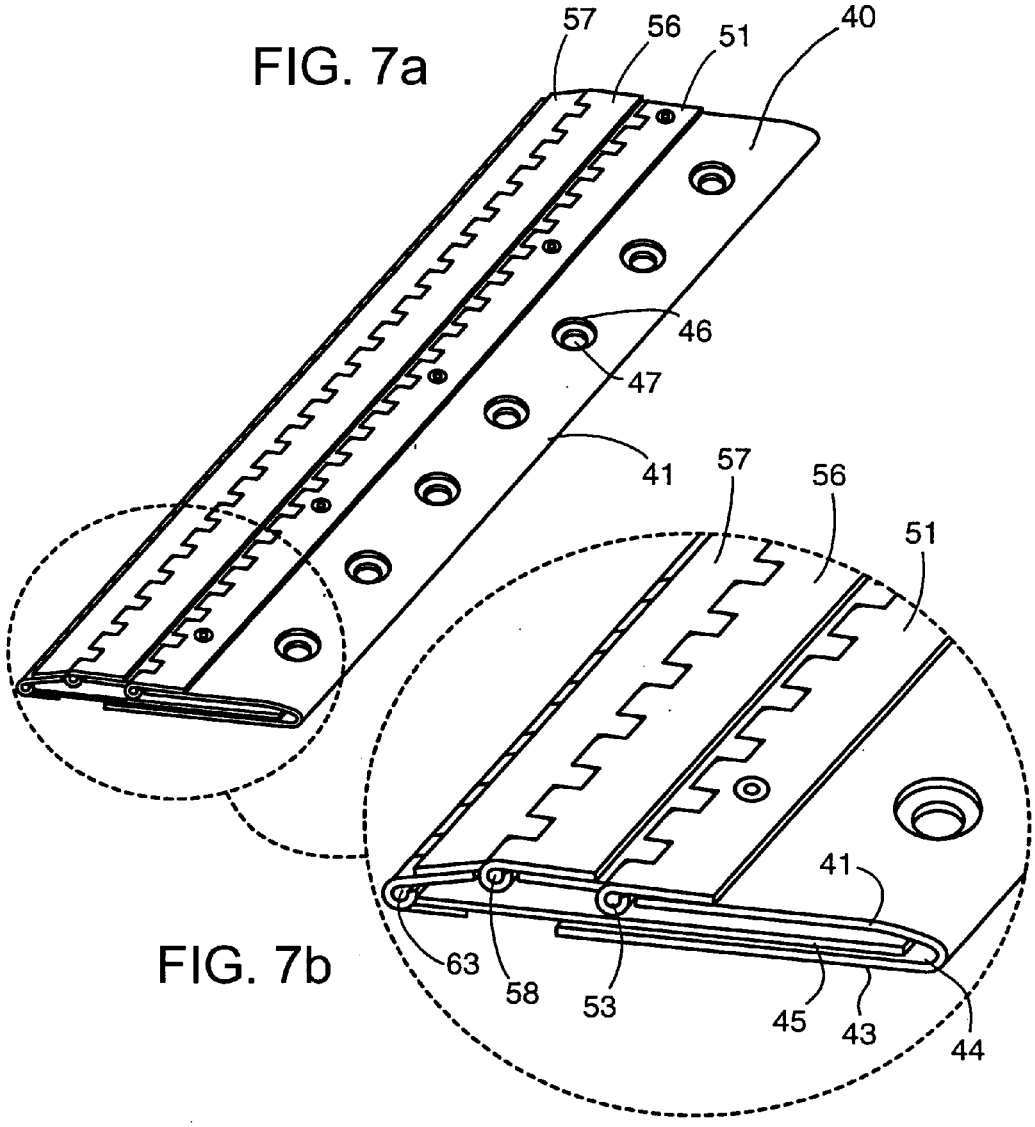
FIG. 7*a* is a perspective view of the hinged mold insert according to the present invention in the flat configuration used for releasing the mold insert from the molded backboard.
FIG. 7*b* is an enlarged view of one end of the hinged mold insert as seen in FIG. 7*a,* illustrating the hinge configuration suitable for releasing the mold insert from the molded backboard.
Figure 10:
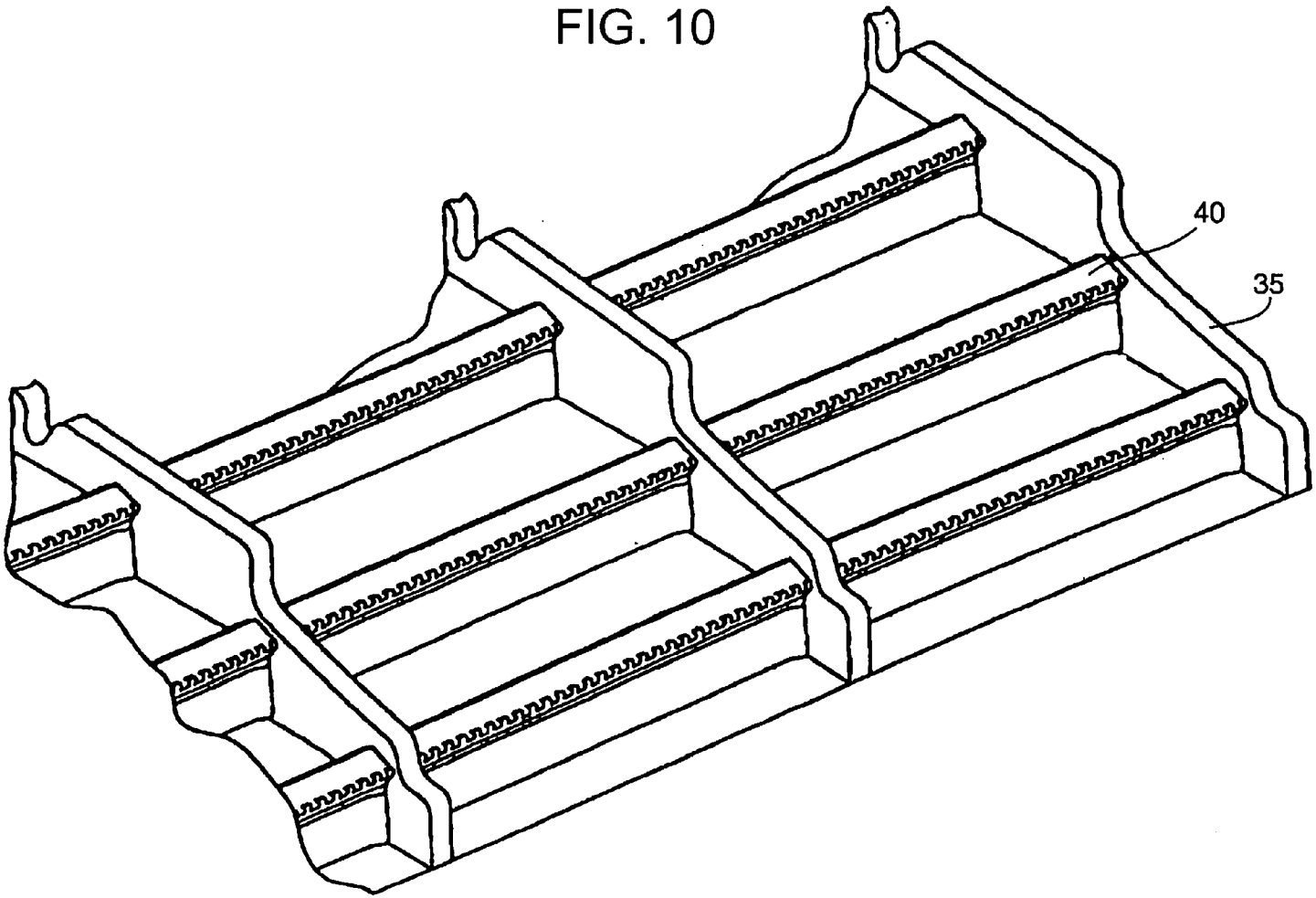
FIG. 10 is a partial perspective view of the mold used for molding the backboard wherein the mold insert is in the triangular configuration used for forming a channel of the molded backboard.
Figure 11:
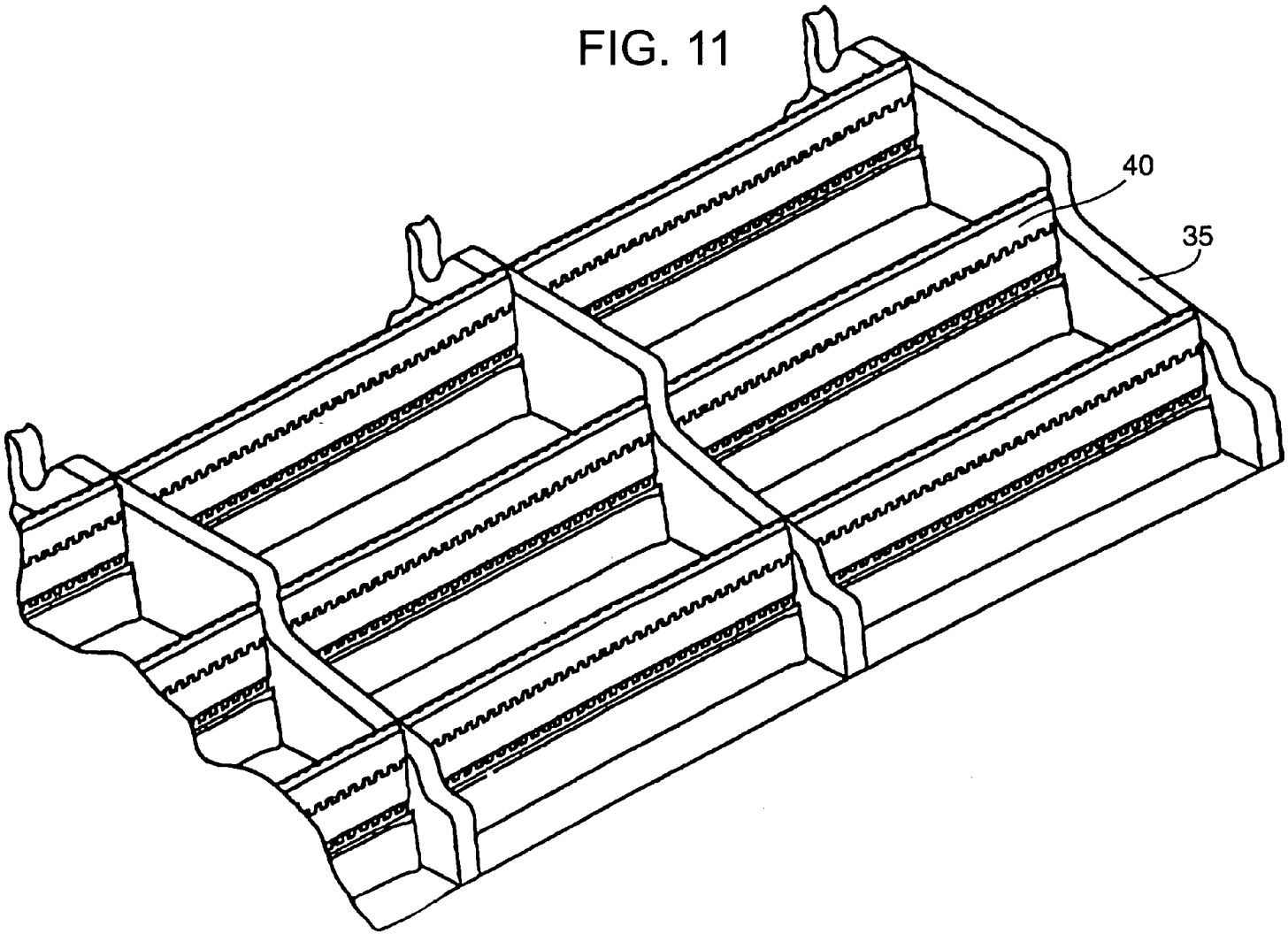
FIG. 11 is a partial perspective view of the mold used for molding the backboard wherein the mold insert is in the flat configuration used for releasing the mold insert from the molded backboard.

Referring to FIGS. 10 and 11, a method of forming the molded backboard 1, is also provided, which comprises preparing a vacuum mold 35 in the shape of the desired backboard, providing a sheet of the appropriate thermoplastic, vacuum molding the thermoplastic sheet, and removing the vacuum formed backboard from the mold. The vacuum mold 35 includes a mold insert for forming the channel 3 (FIG. 2). The mold insert, generally labeled 40 is shown in FIGS. 6*a* and 7*a*. The mold insert 40 operates on a hinge principle such that it can assume a triangular configuration for forming the channel 3 and a straight configuration for releasing the thermoplastic sheet from the mold 35.

The mold insert 40 is made of several overlapping pieces which are attached to one another and allow the mold insert to assume both the triangular configuration seen in FIGS. 6*a*–*b* and the straight configuration seen in FIGS. 7*a*–*b*. The mold insert 40 is shiftable between a molding position as seen in FIGS. 6*a* & *b*, 8 and 10 and a release position as seen in FIGS. 7*a* & *b* and 11. Beneficially, the mold insert 40 shifts from the molding position to the release position and back to the molding position without the need for any outside operative force such as mold pins. In the rare instance where the mold insert 40 does not automatically return to the molding position after removal of a completed backboard due to the effects of gravity, the application of the new mold blank will cause the mold insert 40 to shift to the molding position.

Figure 8:
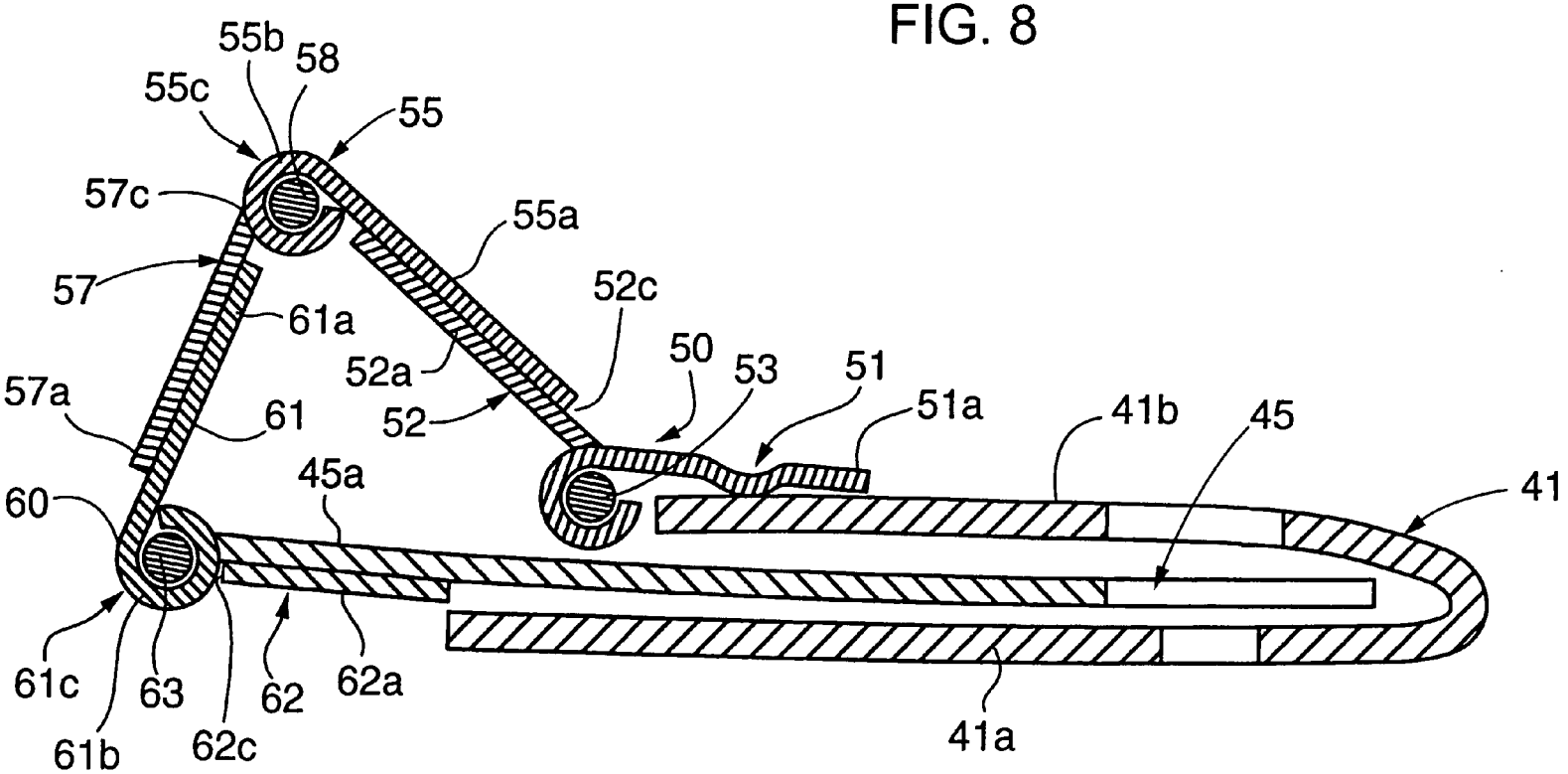
FIG. 8 is a cross-section of the hinged mold insert as seen in FIG. 6*b* along a section line 8.
Figure 9:
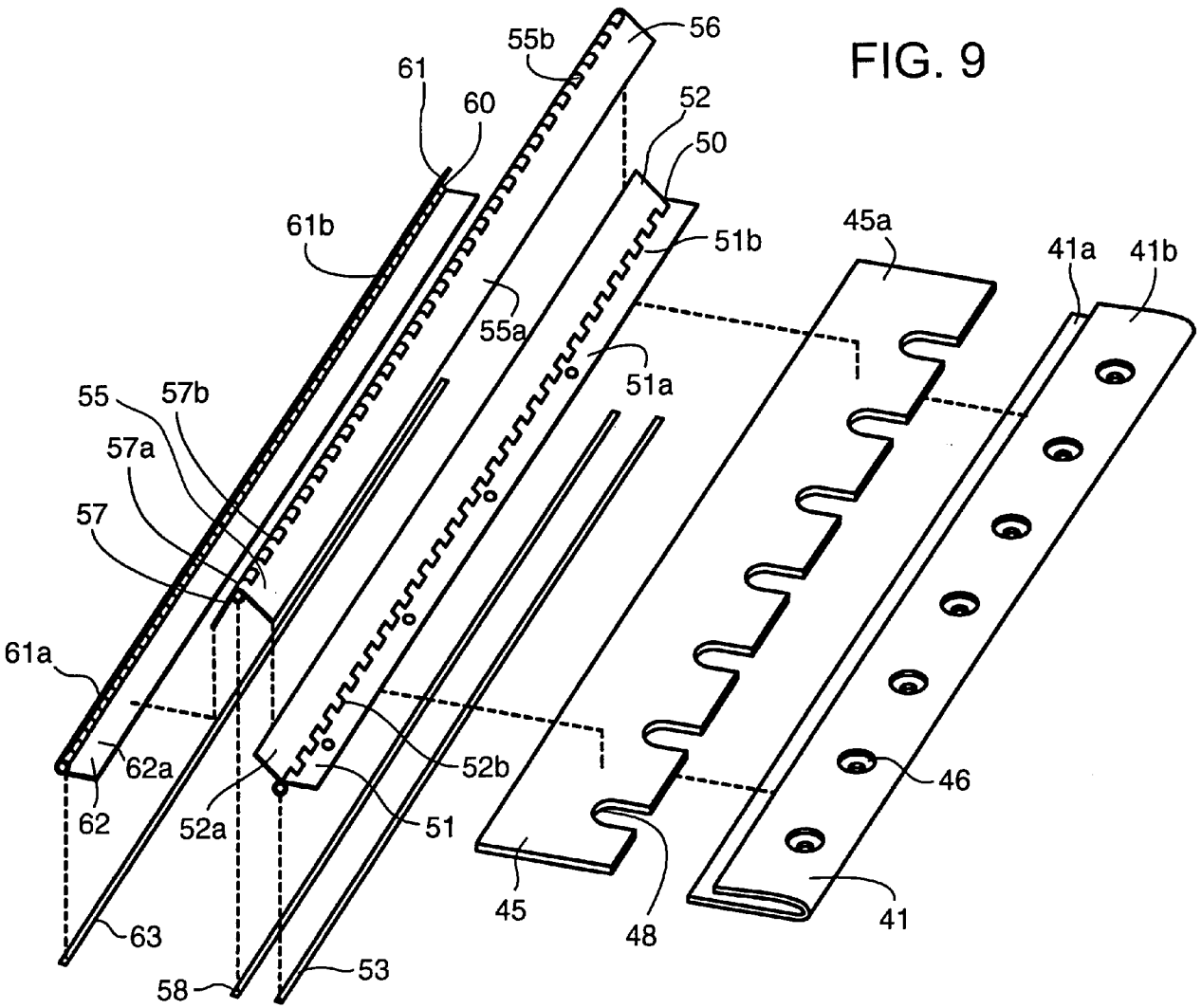
FIG. 9 is an exploded perspective view of the components of the mold insert as seen in FIG. 6*a.*

As shown in FIGS. 8 and 9, the mold insert 40 includes a U-shaped mounting bracket 41 which includes mounting holes 46 which pass through both legs 41*a* & *b* of the mounting bracket and through which mounting screws or bolts (not shown) are used to mount the mold insert in the mold. The first leg 41*a* of the U-shaped mounting bracket is longer than the second leg 41*b* of the bracket. The exterior terminal face of the second leg 41*b* of the mounting bracket 41 is joined to a first hinged section 51 at the flat section 51*a* of the first hinged section by tack welding or other suitable connective process such as solder, rivets, glue, or other welding process.

The first hinged section also includes a hinge joint 51*b* at an edge 51*c* of the first hinged section. The first hinged section is connected to a second hinged section 52 by a hinge pin 53 using the hinge joint 51*b* of the first hinged section and a hinge joint 52*b* along one edge 52*c* of the second hinged section 52. A flat section 52*a* f the second hinged section 52 is also joined to a flat section 55*a* of a third hinged section 55 by tack welding or other suitable connective method as discussed above.

The third hinged 55 section also includes a hinge joint 55*b* at an edge 55*c* of the third hinged section. The third hinged section 55 is connected to a fourth hinged section 57 by a hinge pin 58 using the hinge joint 55*b* of the first hinged section and a hinge joint 57*b* along one edge 57*c* of the fourth hinged section 57. A flat section 57*a* of the fourth hinged section 57 is also joined to a flat section 61*a* of a fifth hinged section 61 by tack welding or other suitable connective method as discussed above.

The fifth hinged section 61 also includes a hinge joint 61*b* at an edge 61*c* of the first hinged section. The fifth hinged section 61 is connected to a sixth hinged section 62 by a hinge pin 63 using the hinge joint 61*b* of the fifth hinged section and a hinge joint 62*b* along one edge 62*c* of the sixth hinged section 62. A flat section 62*a* of the sixth hinged section 62 is also joined to a first end 45*a* of a flat shifting section 45 which is positioned within the channel of the U-shaped mounting bracket 41. The flat shifting section 45 includes cut-outs 48 to permit traversal of the flat shifting section 45 past the mounting bolts which mount the mold insert 40 within the mold 35 (FIGS. 10–11).

When the mold insert is in the release position, the hinged joints are activated such that the flat shifting section 45 is withdrawn from the U-shaped channel of the mounting section 41 to the extent of its maximum travel. When the mold insert is in its molding position, the flat shifting section 45 is moved into the U-shaped channel of the mounting section 41 to the fullest extent possible until the end 45*c* of the flat The mold insert 40 may be made of any suitable material and preferably is made of a metal such as stainless steel which has sufficient strength for vacuum molding and resists corrosion.

As discussed previously, the molded backboard 1 is preferably formed by vacuum molding using the mold 35 with the mold insert 40. When the blank thermoplastic sheet is inserted onto the mold 35 with the mold insert 40, the mold insert 40 assumes a triangular configuration at the end facing the thermoplastic sheet as shown in FIG. 10. Upon vacuum molding, the triangular shape causes a channel 3 to be molded into the newly molded backboard 1. Upon removal of the newly molded backboard, the mold insert 40 shifts into a straight configuration as shown in FIG. 11, allowing the molded backboard 1 to be released from the mold 35. Once the newly molded backboard 1 is removed from the mold 35, the mold insert 40 reverts to its triangular configuration as a result of gravity or as a result of the weight of the next blank thermoplastic sheet being inserted onto the mold 35.

Various additional modifications of the embodiments specifically illustrated and described herein will be apparent to those skilled in the art, particularly in light of the teachings of this invention. The invention should not be construed as limited to the specific form shown and described, but instead is set forth in the following claims.

What is claimed is:

1. A method of vacuum forming a molded article having an undercut channel, said method comprising:

providing a mold containing a mold insert, wherein the mold insert assumes a triangular configuration during molding suitable for molding an undercut channel and wherein said mold insert shifts to a release position upon a withdrawal of said molded article;

placing a thermoplastic blank sheet into said mold;

molding said thermoplastic sheet to form said molded article having an undercut channel; and removing said molded article from said mold, wherein during said removal, said mold insert collapses into itself to provide a straight release configuration, allowing the molded backboard to be released from the mold.

2. The method according to claim 1, wherein said mold insert automatically returns to the molding position following removal of said molded article.

3. The method according to claim 1, wherein said mold insert returns to the molding position upon insertion of a thermoplastic blank sheet.

4. The method according to claim 1, wherein said molded article is a backboard suitable for displaying products.

5. The method of claim 1, wherein said mold insert is a hinged mold insert.

6. A method for producing a plastic article, the method comprising:

molding a plastic sheet around a triangular surface of a mold insert to form a channel in the plastic sheet, the channel having at least one side wall;

pulling the plastic sheet away from the surface of the mold insert so that the side wall exerts a force on the surface of the mold insert, thereby collapsing the mold insert into itself to a straight configuration; and removing the plastic sheet from the mold insert once the mold insert is collapsed to the straight configuration.

7. The method of claim 6, further comprising:

placing the plastic sheet over the mold; and creating at least a partial vacuum between the plastic sheet and the mold to cause the plastic sheet to conform to the mold and to the mold insert.

* * * * *

UNITED STATES PATENT AND TRADEMARK OFFICE

CERTIFICATE OF CORRECTION

PATENT NO. : 7,172,722 B2
APPLICATION NO. : 10/145528
DATED : February 6, 2007
INVENTOR(S) : Wegstein et al.

It is certified that error appears in the above-identified patent and that said Letters Patent is hereby corrected as shown below:

ON THE TITLE PAGE

Item (73) Assignee: "Cards Incorporated" should read --Cards, Incorporated--.
Item (73) Assignee: "MI" should read --MO--.

IN THE SPECIFICATION

Column 2, Lines 23, 25 and 32: "unshaped" should read --u-shaped--.
Column 2, Line 24: "The the" should read --the--.
Column 2, Line 29: "four" should read --fourth--.
Column 5, Line 13: "below" should read --below it.--.
Column 6, Line 12 is "with dr blend" should read --with dry blend--
Column 7, Line 58: "f" should read --of--.
Column 8, Line 23: "flat" should read --flat shifting section.--.

Signed and Sealed this

Seventeenth Day of July, 2007

JON W. DUDAS
*Director of the United States Patent and Trademark Office*